US005703550A

United States Patent [19]

Pawlak et al.

[11] Patent Number: 5,703,550

[45] Date of Patent: Dec. 30, 1997

[54] MAGNETIC LATCHING RELAY

[75] Inventors: Andrzej Marian Pawlak, Troy; Chi Hung Leung, Rochester Hills, both of Mich.

[73] Assignee: General Motors Corporation, Detroit, Mich.

[21] Appl. No.: 578,304

[22] Filed: Dec. 26, 1995

[51] Int. Cl.[6] ..... H01H 51/22

[52] U.S. Cl. ..... 335/78; 335/128

[58] Field of Search ..... 335/78–88, 124, 335/128, 130, 131

[56] References Cited

U.S. PATENT DOCUMENTS

| | | | |
|---|---|---|---|
| 3,146,381 | 8/1964 | Moreau . | |
| 4,020,433 | 4/1977 | Uchidoi et al. . | |
| 4,020,434 | 4/1977 | Jaegle et al. | 335/78 |
| 4,321,570 | 3/1982 | Tsunefuji . | |
| 4,546,339 | 10/1985 | Kubach . | |

*Primary Examiner*—Lincoln Donovan
*Attorney, Agent, or Firm*—Vincent A. Cichosz

[57] ABSTRACT

A low-energy, long-life, magnetic latching apparatus includes a permanent magnet, an electro-magnet and a bi-stable armature. The magnetization axes of the permanent magnet and the electromagnet are substantially parallel to maximize respective flux coupling. Back-iron is located immediately adjacent the permanent magnet opposite the electro-magnet such that the permanent magnet is intermediate the back-iron and electro-magnet. The armature is arranged to minimize any air-gap between the armature and permanent magnet occasioned by the pivotal movement thereof. The back-iron provides for an increased permanent magnet working point and parallel flux path for electro-magnetic flux.

5 Claims, 1 Drawing Sheet

MAGNETIC LATCHING RELAY

BACKGROUND

This invention relates to a bi-stable electro-magnetic latching device. More particularly, the invention sets forth a unique magnetic circuit structure.

Conventional bi-stable latching devices, as found for example in magnetically latching relays, include a permanent magnet and a pair of pole pieces running parallel to each other but perpendicular to the magnetization axis of the permanent magnet. At least one pole piece serves as a magnetic core for a coil winding. A magnetic armature is biased such as by a spring away from the end of the pole pieces. Upon application of a current through the coil in a first direction, the armature is attracted to the pole pieces where the permanent magnet flux is effective to retain the armature against the pole pieces despite the spring bias. Upon application of current in an opposite direction, the armature is released and is retained away from the pole pieces by the spring bias. Examples of such structures may be found in U.S. Pat. Nos. 4,546,339, 4,321,570, and 4,020,433.

In certain applications, it may be desirable to reduce the overall size of such devices. However, reductions in the number of turns of a coil has substantial negative effects on the electro-magnetic flux generating capability thereof. The effect is even more pronounced due to the dual air gaps located between respective pole pieces and the armature. It may also be desirable to minimize power consumption of such devices, especially in application utilizing a multiplicity of such devices where available power is substantially limited. For devices such a miniature relays, a prime objective of any design is to assure that appropriate retentive forces, both in the spring biased and magnetically latched positions, are maintained. Such requirements often require substantial magneto-motive forces to latch and unlatch the device thereby requiting substantial power and magnetic fields potentially damaging the permanent magnet material of the device.

SUMMARY

Therefore, it is a primary object of the present invention to provide a bi-stable magnetically latching device which overcomes the shortcomings of the prior art devices.

In accordance with one aspect of the present invention, a magnetic latching apparatus having a permanent magnet, electro-magnet and bi-stable armature provides a high permeance flux path in the magnetic circuit immediately adjacent the permanent magnet for increasing the permanent magnet working point and for preventing permanent magnet exposure to direct demagnetizing forces.

According to another aspect of the invention, the armature is pivotally connected to the back iron at one end thereof, thereby minimizing any air gap with the permanent magnet.

According to another aspect of the invention, the electro-magnet has a magnetization axis substantially parallel with the magnetization axis of the permanent magnet A preferred embodiment of the present invention has a substantially 'L' shaped high permeability magnetic member. One leg thereof comprises back iron, the other leg thereof comprises a high permeance flux path and support member for the electro-magnet core opposite the back iron. Disposed about the core is a coil adapted for hi-directional energization. A permanent magnet is disposed immediately adjacent the back iron between the back iron and core. An armature is pivotally coupled to the back iron opposite the high permeability magnetic member supporting the core. The armature is spring biased away from the core into a first bi-stable spring biased position. The armature has a second bi-stable magnetically latched position whereat the armature is in substantial contact with the core at the non-pivotally connected end. The permanent magnet and the electro-magnet have parallel magnetization axes.

BRIEF DESCRIPTION OF THE DRAWINGS

The present invention will now be described, by way of example, with reference to the accompanying drawings, in which.

DETAILED DESCRIPTION

Figure 1:
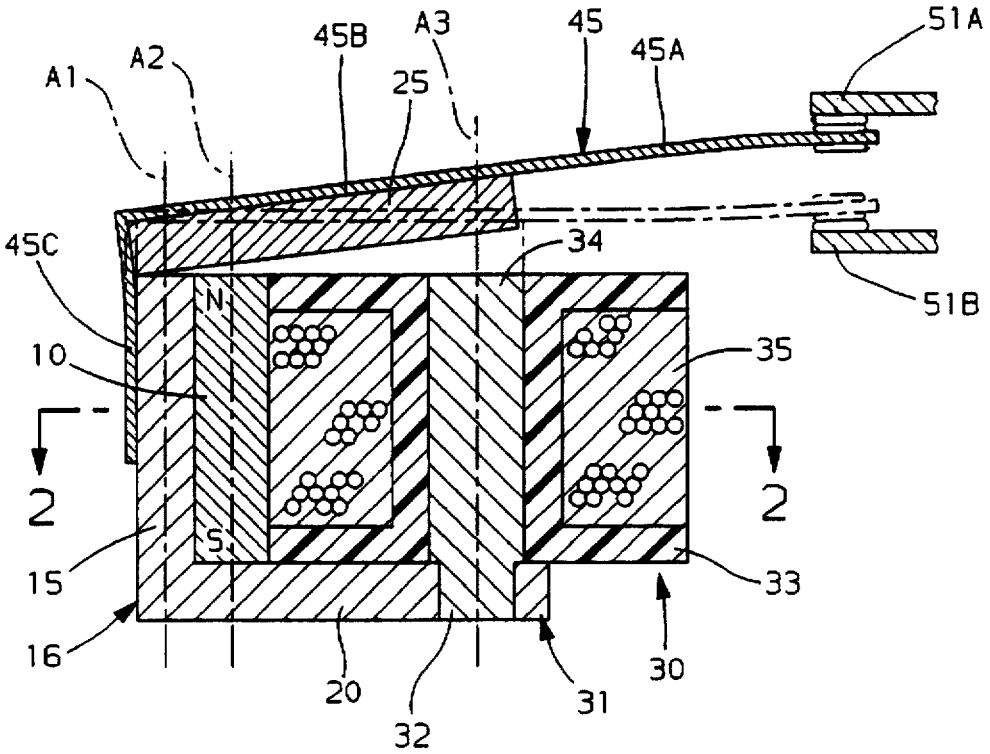
FIG. 1 illustrates the present invention as embodied in a bi-stable magnetic latching relay; and, FIG. 2 provides a sectional view of FIG. 1 taken through the line 2—2 in FIG. 1.

A full description is set forth with reference to FIGS. 1 and 2 which are schematically illustrative of a latching relay embodying the present invention. The relay shown is a hi-stable magnetically latching relay. The electrical switching portions of the relay comprise a moveable contact member 45 including contact arm 45A, and a pair of stationary contacts arms 51A and 51B. At the contact end of each arm 51A and 51B, and secured thereto, is a respective contact pad. Contact arm 45A has a contact pad on an upper and lower side thereof, the upper contact pad for contact with arm 51A contact pad, and the lower contact pad for contact with arm 51B contact pad. Contact arm 45A is shown in FIG. 1 in a first one of two bi-stable positions. The broken line portion of FIG. 1 shows the second one of two bi-stable positions. The first position may hereafter be referred to as the spring biased position while the second position may hereafter be referred to as the magnetically latched position.

Contact member 45 is manufactured from an electrically conductive and yieldable material, preferably copper or copper alloy. The portion 45B of member 45 extends across the top surface of armature 25 and is secured thereto such as by a conventional staking process. The member 45 then wraps the back-side of the armature 25 with a portion 45C thereof extending secured to back iron 15 in a similar fashion. Portion 45C is formed such that it biases the armature 25 toward the position illustrated (i.e. upward in FIG. 1). Armature 25 is formed of ferromagnetic material such as 1008 steel. Armature 25 is thereby pivotally secured at one end thereof to allow for movement between the two bi-stable positions Back iron 15 similarly is formed of a ferromagnetic material, preferably 1008 steel. Back iron 15 is preferably formed as one leg of an 'L' shaped high permeance bracket 16 which also includes as the other leg a high permeance member 20. Bracket 16 provides for structural support of the armature as described and, additionally, of electro-magnet 30 at the end of member 20 opposite the back iron 15. Electro-magnet 30 comprises a core 31 formed of magnetic material of similar composition to the other magnetic structures. Core 31, formed from ferromagnetic material such as 1008 steel, is substantially cylindrical having a pair of axially opposite ends 32 and 34, a portion of end 32 being press fitted into an opening in member 20. Electro-magnet 30 further comprises a non-magnetic spool 33 which carries a wound coil 35. Coil 35 may be a single filament coil having a pair of leads or a dual filament coil having respective pairs of leads.

A permanent magnet 10, preferably a high energy density rare-earth magnet such as samarium-cobalt or neodymium alloys, is interposed the back-iron and core 31. Preferably, the permanent magnet is immediately adjacent back iron 15 as illustrated. Each of the back iron 15, magnet 10, and core 31 has an axis associated therewith and labeled A1, A2, and A3, respectively. Each axis is parallel the other axes and lies in a plane labeled P1 in FIG. 2. Axis A2 associated with magnet 10 represents the desired magnetic pole alignment of the magnet 10. That is to say the north and south poles of the magnet are aligned axially opposite with respect to the axis A2. Similarly, axis A3 associated with the core 31 represents the desired magnetic pole alignment of the electro-magnet 30. Both axes A2 and A3 further represent substantial axes of symmetry for the permanent magnet 10 and core 31, respectively. The axis A1 represents a high permeability flux path for permanent magnet flux and electro-magnet flux. The axis A1 further represent a substantial axis of symmetry with respect to back iron 15.

Figure 2:
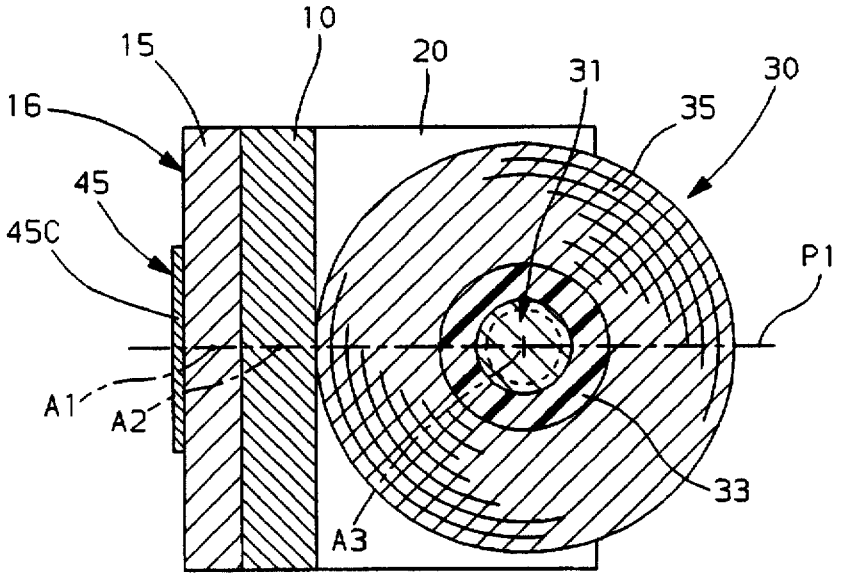

An end view of the back iron 15, the magnet 10 and core 34 taken in the same direction as the sectional view of FIG. 2 would show end faces of the respective structure of substantially consistent dimensions to the cross sectional dimensions shown in FIG. 2. The pivotal arrangement of the armature 25 relative to the back iron 15 maintains any air gap therebetween to a minimum in either of the two bi-stable states. Locating the magnet 10 immediately adjacent to the back iron 15 likewise results in minimal air gap between the adjacent pole of the magnet 10 and the armature 25 in either bi-stable state.

With the armature 25 in the spring biased position as illustrated, the permanent magnets operating point is at its lowest location because of the presence of the high reluctance air-gap between the core 31 and armature 25, thus generating magnetic flux insufficient to cause closure of the armature to the magnetically latched position. The flux density from the permanent magnet alone across the gap between the core 31 and the armature 25 is insufficient to overcome the spring force. With the energization of coil 35 in such a manner as to produce polarity of the magnetic poles opposite that of the permanent magnet 10 pole polarity (i.e. S pole at end 34 and N pole at end 32), the flux density across the air gap between the core 31 and armature 25 becomes sufficient to balance the spring force and eventually overcome the spring force to close the armature into contact with the core 31. The armature 25 will remain in the magnetically latched position even after de-energization of the coil due to the substantial permanent magnet flux through the armature 25, core 31 and member 20.

In the transition of the armature 25 from the spring biased position to the magnetically latched position, the structure described operates with certain unique advantages. The back iron 15 provides for an increased working point of the magnet 10 relative to the working point otherwise effective without the back iron 15. Therefore, when the coil is so energized to attract the armature to the core 31, the permanent magnet contribution to the flux density across the air gap between the core 31 and armature is greater than that effected without the back iron. The movement of the armature may thereby be carried out with less magneto-motive force contribution from the electro-magnet. This in turn allows operation of an equivalent coil at lower currents or a coil having fewer turns at the same current, or a combination of less current and less turns. The power requirements are reduced regardless of the coil/current design selection. Reducing the coil rams may reduce the mass and volume of the relay as well as reduce the inductance thereof. Reducing the inductance will of course result in faster response times due to a concomitant reduction in the current rise time and establishment of the electro-magnetic field. The retentive force provided by the permanent magnet alone is also greater than otherwise would be the case in the absence of the back iron by virtue of the increased permanent magnet working point. The parallel axes A2 and A3, which provide parallel symmetry as between the respective magnetic axes of the permanent magnet 10 and the electro-magnet 30. This arrangement provides for substantially maximum mutual flux coupling between the permanent magnet flux and the electro-magnetic flux leading to greater flux densities than available with other conventional non-parallel arrangements.

With the energization of coil 35 in such a manner as to produce polarity of the magnetic poles the same as that of the permanent magnet 10 pole polarity (i.e. N pole at end 34 and S pole at end 32), the flux density across the air gap between the core 31 and armature 25 becomes insufficient to balance the spring force and eventually the spring force overcomes the magnetic force to release the armature into the spring biased position. The armature 25 will thereafter remain in the spring biased position even after de-energization of the coil due to the spring force acting thereon.

In the transition of the armature 25 from the magnetically latched position to the spring biased position, the structure described also operates with certain unique advantages. Again, because of the parallel symmetry as between the respective magnetic axes of the permanent magnet 10 and the electromagnet 30 and the substantially maximum mutual flux coupling between the permanent magnet flux and the electro-magnetic flux, the retentive magnetic force may be more efficiently counteracted, thereby requiring less magneto-motive force than otherwise required by other conventional non-parallel arrangements. The back iron 15 provides for a parallel flux path for the electro-magnetic flux, without which the electro-magnetic flux would undesirable act upon the permanent magnet 10. Such continued repetitive application of opposing flux would permanently damage and weaken the permanent magnet. The presence of the back iron ensures that the permanent magnet is not significantly exposed to direct de-magnetizing flux from the electro-magnet when releasing the armature from the magnetically latched position.

We claim:

1. A magnetic latching apparatus having a permanent magnet, electro-magnet, and an armature having a spring biased first bi-stable position and a magnetically latched second bi-stable position, said coil adapted for bi-directional energization to selectively establish one of said first and second bi-stable positions of the armature, the apparatus comprising, in combination:

said permanent magnet having a first magnetization axis;

back iron immediately adjacent said permanent magnet;

said electro-magnet including a coil and a core, said electromagnet having a second magnetization axis;

wherein said permanent magnet, back iron and electro-magnet core are arranged such that the permanent magnet is substantially intermediate the back iron and electro-magnet core and the first and second magnetization axes being substantially parallel; and, said armature extending from said back iron to said electro-magnet core and pivotally secured at a first end proximate said back iron such that a second end proximate said electro-magnet core is free to move toward and away from said electro-magnet core to establish said second and first bi-stable positions, respectively.

2. A magnetic latching apparatus as claimed in claim 1 further comprising an electrical conductor secured to the armature for movement therewith and adapted for coupling to a stationary contact when said armature is in the first bi-stable position.

3. A magnetic latching apparatus as claimed in claim 1 further comprising an electrical conductor secured to the armature for movement therewith and adapted for coupling to a stationary contact when said armature is in the second bi-stable position.

4. A magnetic latching apparatus as claimed in claim 1 further comprising an electrical conductor secured to the armature for movement therewith and adapted for coupling to a first stationary contact when said armature is in the first bi-stable position and to a second stationary contact when said armature is in the second bi-stable position.

5. A magnetic latching apparatus having a permanent magnet, electro-magnet including magnetic core and coil, and bi-stable magnetic armature having a spring biased unlatched position and a permanent magnet flux biased latched position, said coil adapted for bi-directional energization to selectively establish one of said latched and unlatched positions of the armature, the apparatus comprising, in combination:

said permanent magnet having a first magnetization axis and a pair of opposite pole faces aligned therewith;

back iron comprising a first high permeance flux path which is substantially parallel to said magnetization axis;

said electro-magnet having a second magnetization axis substantially parallel with said first magnetization axis, the core having a pair of axially opposite ends and comprising a second high permeance flux path which is substantially parallel to said first and second magnetization axes;

said permanent magnet, back iron and core being arranged such that the permanent magnet is intermediate the back iron and ferromagnetic core;

a high permeance member extending substantially perpendicular to said first and second magnetic axes from said back iron across one of said pair of axially opposite pole faces of said permanent magnet and one of said pair of axially opposite ends of said core, said member being in substantial contact with said back iron, permanent magnet and core; and, said armature pivotally coupled to said back iron and extending substantially perpendicular therefrom with respect to said first and second magnetic axes across the other of said pair of axially opposite pole faces of said permanent magnet and the other of said pair of axially opposite ends of said core, said armature being in spaced adjacency relative to the core when in the spring biased unlatched position, and in substantial contact with the core when in the permanent magnet flux biased latched position.

* * * * *